US010094266B2

(12) United States Patent
Poschl et al.

(10) Patent No.: US 10,094,266 B2
(45) Date of Patent: Oct. 9, 2018

(54) COOLING STRUCTURE FOR A CYLINDER HEAD OF AN INTERNAL COMBUSTION ENGINE

(71) Applicant: AVL LIST GMBH, Graz (AT)

(72) Inventors: Robert Poschl, Judendorf-Strassengel (AT); Robert Toth, Budapest (HU)

(73) Assignee: AVL List GmbH, Graz (AT)

( * ) Notice: Subject to any disclaimer, the term of this patent is extended or adjusted under 35 U.S.C. 154(b) by 112 days.

(21) Appl. No.: 14/974,939

(22) Filed: Dec. 18, 2015

(65) Prior Publication Data

US 2016/0195035 A1 Jul. 7, 2016

(30) Foreign Application Priority Data

Jan. 2, 2015 (EP) ..... 15150012

(51) Int. Cl.
*F02F 1/40* (2006.01)
*F02F 1/42* (2006.01)
(Continued)

(52) U.S. Cl.
CPC ..... *F01P 3/14* (2013.01); *F01P 3/16* (2013.01); *F02F 1/40* (2013.01); *F01P 3/02* (2013.01)

(58) Field of Classification Search
CPC ..... F01P 3/02; F01P 3/14; F01P 3/16; F02F 1/10; F02F 1/4285; F02F 1/38; F02F 2001/248; F02F 1/40; F02F 1/36
(Continued)

(56) References Cited

U.S. PATENT DOCUMENTS 1,840,922 A 1/1932 Steiner
4,889,080 A * 12/1989 Oguri ..... F02F 1/40 123/41.31

(Continued)

FOREIGN PATENT DOCUMENTS

| | | |
|---|---|---|
| DE | 102008047185 | 4/2010 |
| GB | 828014 | 2/1960 |
| WO | 2015000616 | 1/2015 |

OTHER PUBLICATIONS

English Abstract of DE 102008047185.

*Primary Examiner* — Syed O Hasan
(74) *Attorney, Agent, or Firm* — Dykema Gossett PLLC

(57) ABSTRACT

A cooling structure (1) for a cylinder head (2) of an internal combustion engine includes a lower first cooling jacket (12) adjacent to a fire deck (13) and an upper second cooling jacket (14) adjacent to an intermediate deck (15), the first and second cooling jackets (12, 14) being flow connected by at least one transfer opening (27, 31) of the intermediate deck (15), the first cooling jacket (3) including at least one center cooling chamber (17) and an outer cooling chamber arrangement with at least one first outer cooling chamber (16), the outer cooling chamber (16) and the center cooling chamber (17) being flow connected by at least one exhaust side first radial passage (19) extending in a region of the exhaust valve bridge (8) and by at least one second radial passage (20, 21), the first radial passage (19) and the second radial passage (20, 21) being streamed hydraulically in parallel. The outer cooling chamber arrange-ment of the first cooling jacket (12) includes at least one first outer cooling chamber (16) and at least one second outer cooling chamber (29), which is separated from the first outer cooling chamber (16) by at least one flow restricting passage, whereas the second outer cooling chamber (29) is flow connected with the center cooling chamber (17) by at least one intake radial (Continued)

passage (24, 25, 26) extending in a region of an intake valve bridge (9) and/or in a region of an intake-exhaust valve bridge (10, 11).

12 Claims, 3 Drawing Sheets

(51) Int. Cl.
*F01P 3/14* (2006.01)
*F01P 3/16* (2006.01)
*F01P 3/02* (2006.01)

(58) Field of Classification Search
USPC ..... 123/41.34, 193.5, 41.82 R
See application file for complete search history.

(56) References Cited

U.S. PATENT DOCUMENTS

| | | | | |
|---|---|---|---|---|
| 5,836,272 | A * | 11/1998 | Sakurai | F02F 1/242 123/41.28 |
| 6,928,964 | B2 * | 8/2005 | Obermayer | F01P 3/16 123/41.82 R |
| 7,520,257 | B2 | 4/2009 | Adams et al. | |
| 8,939,116 | B2 | 1/2015 | Pöschl et al. | |
| 2002/0124815 | A1 | 9/2002 | Ishiguro et al. | |
| 2004/0040521 | A1 * | 3/2004 | Hardin | F02B 75/20 123/41.82 R |
| 2009/0000578 | A1 | 1/2009 | Reustle | |

* cited by examiner

COOLING STRUCTURE FOR A CYLINDER HEAD OF AN INTERNAL COMBUSTION ENGINE

BACKGROUND OF THE INVENTION

Field of the Invention

The invention relates to a cooling structure for a cylinder head of an internal combustion engine with at least two exhaust valves and at least one intake valve per cylinder, wherein at least one exhaust valve bridge is located between two adjacent exhaust valves and at least two intake-exhaust valve bridges are located each between an exhaust valve and an adjacent intake valve, with preferably at least one intake valve bridge being located between two adjacent intake valves, the cooling structure including a lower first cooling jacket adjacent to a fire deck and an upper second cooling jacket adjacent to an intermediate deck, the first and second cooling jackets being flow connected by at least one transfer opening of the intermediate deck, the first cooling jacket including at least one centre cooling chamber and an outer cooling chamber arrangement with at least one first outer cooling chamber, the outer cooling chamber and the centre cooling chamber being flow connected by at least one exhaust side first radial passage extending in a region of the exhaust valve bridge and by at least one second radial passage, preferably including an annular cooling channel surrounding a valve seat of the exhaust valve, wherein the first radial passage and the second radial passage are streamed hydraulically in parallel.

Typical conventional large engines apply so called "bottom-up" radial cooling concepts, wherein coolant enters into a lower cooling jacket and flows directly from outside cooling chambers radially towards the centre cooling chamber surrounding a fuel injector or a pre-chamber in the case of gas engines. But with such a conventional cooling concept, in certain cases the discharge of heat in the region of the exhaust valve bridges or intake-exhaust valve bridges is restricted and often insufficient.

EP 1 239 135 A2 describes a cooling structure of a cylinder head with radial cooling passages located in the region of an exhaust valve bridge and intake-exhaust valve bridges, wherein the radial cooling passages of the intake-exhaust bridge is located downstream of the cooling passages of the exhaust valve bridge. Each cooling water passage has a circular shape in cross section in radial direction.

DE 10 2007 030 482 A1 discloses a cylinder head with two exhaust valves and two intake valves, with a radial cooling passage situated between the exhaust valves. The cooling system comprises annular cooling channels arranged around the valve seats of each exhaust valve. Each annular cooling channel originates from the radial cooling passage. The cooling idea considers passages near the exhaust valves right after the inflow into the cylinder head water jacket, which results in a by-pass for the exhaust valve bridge.

DE 10 2008 047 185 A1 shows a cooling concept of a cylinder head without cooled exhaust valve seats with an exhaust valve bridge and an intake valve bridge which are connected in series. Furthermore the intake-exhaust valve bridges are cooled hydraulically in parallel with the exhaust valve bridge on two separated vertical levels of flow passages. Hence, the complete flow from exhaust valve bridge must enter the intake valve bridge and can not be used for cooling the exhaust-intake valve bridges in the parallel path.

Considering the above, it is the object of the present invention to enhance the cooling of thermally critical areas of a cylinder head, particularly hot spots of the fire deck.

SUMMARY OF THE INVENTION

According to the invention, the outer cooling chamber arrangement of the first cooling jacket includes at least one first outer cooling chamber and at least one second outer cooling chamber which is separated from the first outer cooling chamber by at least one flow-restricting passage, wherein the second outer cooling chamber is flow connected with the centre cooling chamber by at least one intake radial passage extending in a region of the intake valve bridge and/or in a region of the intake-exhaust valve bridge.

The invention enables concentrating of all coolant flow on the exhaust side where during operation the thermally more critical areas of a cylinder head are located. All coolant flows through the exhaust valve bridge and past the seats of the exhaust valves. Apart from the centre also, the remaining valve bridge areas are cooled. In a variant of the invention the first outer cooling chamber is arranged on the exhaust side and/or the second outer cooling chamber is arranged on the intake side.

Preferably, the second outer cooling chamber is flow connected to a transfer cooling manifold. In a variant the transfer cooling manifold surrounds the second outer cooling chamber as a circular ring segment. This means that the second outer cooling chamber arrangement is located between the transfer cooling manifold and the centre of the cooling structure.

In another variant of the invention the coolant enters the cooling structure through at least one coolant entrance opening located upstream of the at least one first and/or second radial passage and the at least one intake radial passage is located downstream of the first and/or second radial passage. The first and second radial passages are flowed through in parallel, but the intake radial passages are flowed through serially in relation to the first and second radial passages. All intake radial passages, i.e., in the regions of the intake valve bridges as well as in the regions of the intake-exhaust valve bridges are streamed hydraulically in parallel relating to each other.

Preferably, at least one first transfer opening may originate from the centre cooling chamber. In a variant of the invention at least one second transfer opening may originate from the second outer cooling chamber or from the transfer cooling manifold. In yet another variant of the invention multiple second transfer openings originate from the second outer cooling chamber and/or from the transfer cooling manifold and/or from the region of second radial transfer passages flow connecting the second outer cooling chamber and the transfer cooling manifold.

Preferably, a flow section of the first transfer opening of the centre cooling chamber is smaller than a flow section of at least one second transfer opening of the second outer cooling chamber or the transfer cooling manifold.

The combination of coolant streaming in parallel and in serial increases the cooling capacity due to higher flow rates through the first and second radial passages. So higher flow rates for exhaust side hot regions of the cylinder head are available.

Preferably the first outer cooling chamber is flow connected to an inlet cooling manifold. In a variant of the invention the first outer cooling chamber may be located between the inlet cooling manifold and the exhaust valves. In yet another variant the inlet cooling manifold is formed as a circular ring segment.

Preferably, the first cooling jacket includes at least one cooling manifold arrangement with at least one inlet cooling manifold which is flow connected to the first outer cooling chamber and at least one transfer cooling manifold which is flow connected to the second outer cooling chamber, wherein the inlet cooling manifold is separated from the transfer cooling manifold by at least one flow restricting passage.

In a variant of the invention, the flow-restricting passage is realized by either a solid interruption or a throttle point.

The present invention will be described in more detail with reference to the drawings.

DETAILED DESCRIPTION

Figure 1:
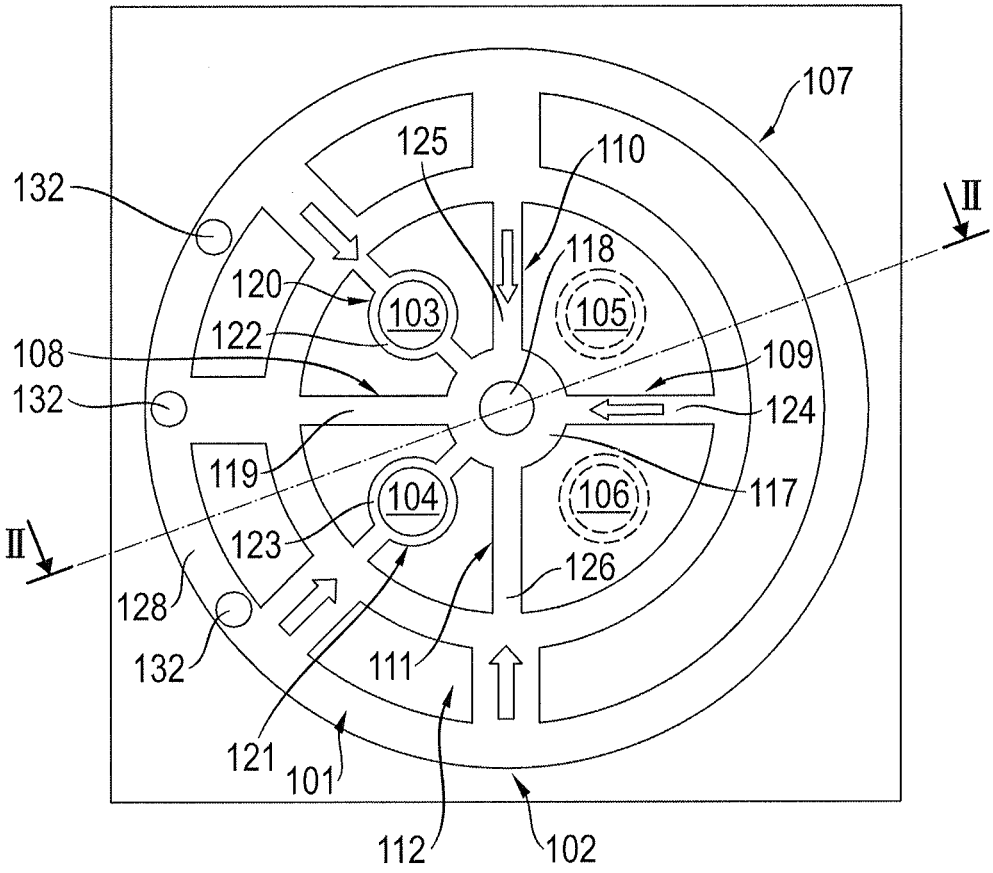
Prior Art Fig. 1
FIG. 1 shows a schematic sectional representation in plan view of a conventional cooling structure of a cylinder head of a cylinder according to the state of art.
Figure 2:
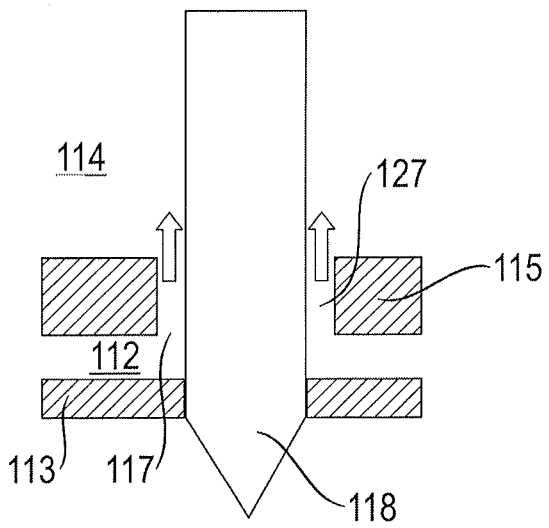
Prior Art Fig. 2
FIG. 2 shows, on an enlarged scale, part of a sectional view of the conventional cooling structure of FIG. 1 according to line II-II in FIG. 1.

FIGS. 1 and 2 show a conventional cooling structure 101 of a cylinder head 102 with two exhaust valves 103, 104 and two intake valves 105, 106 per cylinder 107. An exhaust valve bridge 108 is located between the exhaust valves 103, 104 and at least one intake valve bridge 109 is located between the intake valves 105, 106. Two intake-exhaust valve bridges 110, 111 are located each between an exhaust valve 103, 104 and an adjacent intake valve 105, 106. The cooling structure 101 comprises a lower first cooling jacket 112 adjacent to the fire deck 113 and an upper second cooling jacket 114 adjacent to an intermediate deck 115. The first 112 and second cooling jackets 114 are flow connected by a transfer opening 127 of the intermediate deck 115. The first cooling jacket 112 includes an outer cooling chamber 116 and a centre cooling chamber 117 encasing a centric fuel injector 118.

The coolant enters the cooling structure's 101 first cooling jacket 112 through coolant entrance openings 132 located on the exhaust side. The coolant enters into the upper second cooling jacket 114 via the transfer opening 127 in the intermediate deck 115, the transfer opening 127 originating from the centre cooling chamber 117 and connecting the first 112 and second cooling jackets 114. The outer cooling chamber 116 and the centre cooling chamber 117 are flow connected by an exhaust side first radial passage 119 extending in a region of the exhaust valve bridge 108 and by second radial passages 120, 121 each comprising an annular cooling channel 122, 123 surrounding a valve seat of the exhaust valves 103, 104. Further the outer cooling chamber 116 and the centre cooling chamber 117 are flow connected by radial passages 124, 125, 126 extending in regions of the intake valve bridge 109 and the intake-exhaust valve bridges 110, 111. The outer cooling chamber 116 is flow connected to a circular surrounding inlet cooling manifold 128, wherein the outer cooling chamber 116 is located between the inlet cooling manifold 128 and the exhaust valves 103, 104. Coolant enters through the coolant entrance openings 132 of the intake coolant manifold 128. Both, the inlet cooling manifold 128 and the outer cooling chamber 116 surround the centre cooling chamber 117 and the centric fuel injector 118 in a full, uninterrupted circle.

Coolant entering the cooling structure 101 is guided in radial direction and also in circumferential direction through the intake coolant manifold 128 and the outer cooling chamber 116. Exhaust valve bridge 108, intake valve bridge 109 and intake-exhaust valve bridges 110, 111 are flown through by the coolant in parallel to the second radial passages 120, 121 and the valve seat ring cooling in the form of annular cooling channels 122, 123. Consequently, critical areas of the cylinder head 102 can feature only part of total flow and are insufficiently cooled.

Therefore, with such a conventional cooling concept the discharge of heat in the region of exhaust valve bridges is insufficient. Most flow is accumulated at the injector 118 to enter the second cooling jacket 114 and be discharged through a main outlet (not shown).

FIGS. 3 to 6 show a cooling structure 1 of a cylinder head 2 according to the present invention with two exhaust valves 3, 4 and two intake valves 5, 6 per cylinder 7. An exhaust valve bridge 8 is located between the exhaust valves 3, 4. An intake valve bridge 9 is located between the intake valves 5, 6. Two intake-exhaust valve bridges 10, 11 are located each between an exhaust valve 3; 4 and an adjacent intake valve 5; 6.

The cooling structure 1 comprises a lower first cooling jacket 12 adjacent to the fire deck 13 and an upper second cooling jacket 14 adjacent to an intermediate deck 15. The fire deck 13 separates the cylinder head 2 from the cylinder's combustion chamber (not shown in figures). The intermediate deck 15 is located between first 12 and upper second cooling jacket 14. The first cooling jacket 12 includes an outer cooling chamber 16 and a centre cooling chamber 17 encasing a centric fuel injector 18, instead of a fuel injector 18 other suitable equipment, e.g. a pre-chamber in case of gas engines may be provided. The first 12 and second cooling jacket 14 are connected by transfer openings of the intermediate deck 15, e.g., by a first transfer opening 27 originating from the centre cooling chamber 17.

The first outer cooling chamber 16 and the centre cooling chamber 17 are flow connected by a first radial passage 19 on the exhaust side, the first radial passage 19 extending in a region of the exhaust valve bridge 8. In addition, the first outer cooling chamber 16 and the centre cooling chamber 17 are flow connected by second radial passages 20, 21 each in the embodiment shown comprising an annular cooling channel 22, 23 surrounding a valve seat of the exhaust valves 3, 4.

Figure 3:
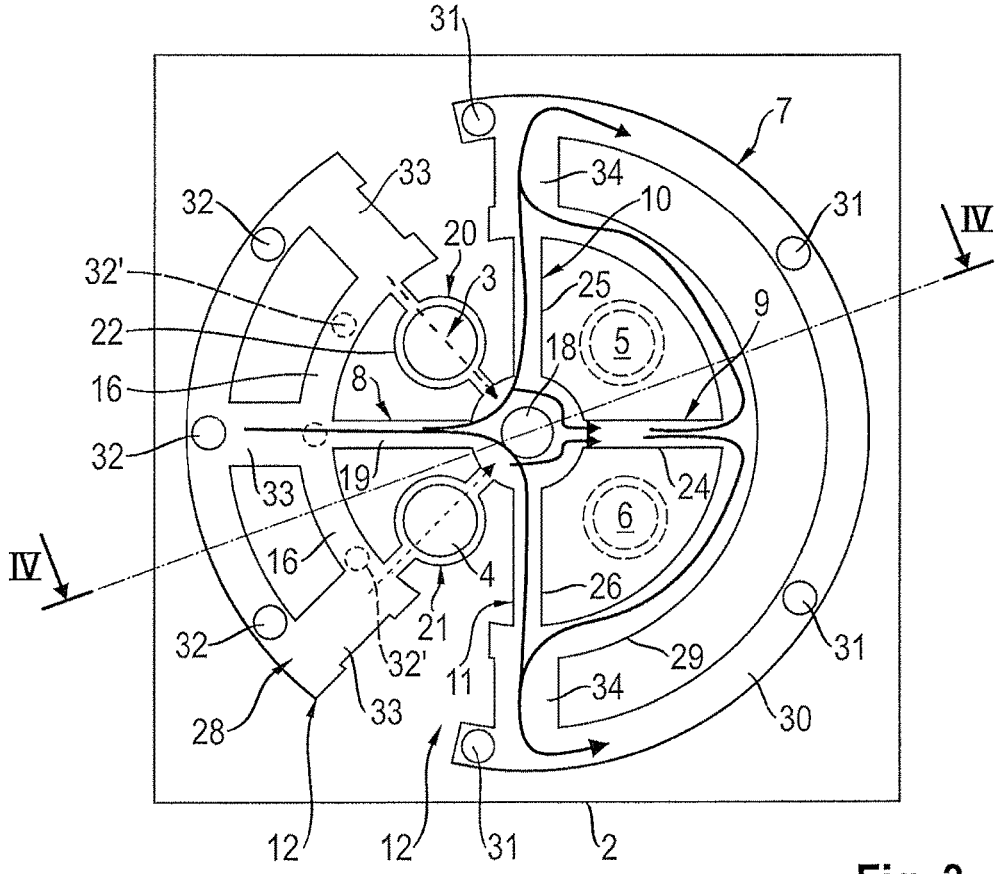
FIG. 3 shows a schematic sectional plan-view representation of a cooling structure of a cylinder head of a cylinder according to the present invention according to line III-III in FIG. 4.
Figure 4:
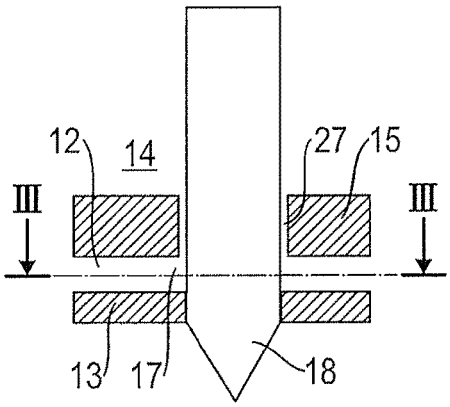
FIG. 4 shows on an enlarged scale, part of a sectional view of the cooling structure according to the invention according to line IV-IV in FIG. 3.
Figure 6:
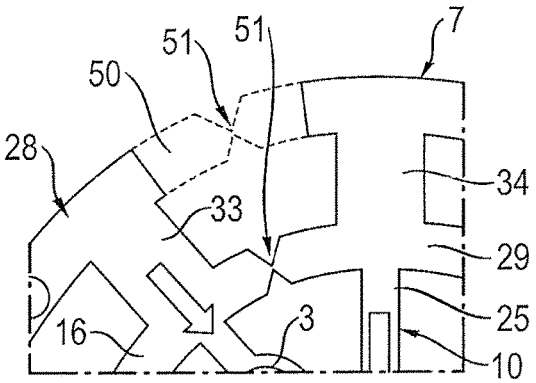
FIG. 6 shows a detail of a schematic sectional plan-view representation of another embodiment of the invention.
Figure 5:
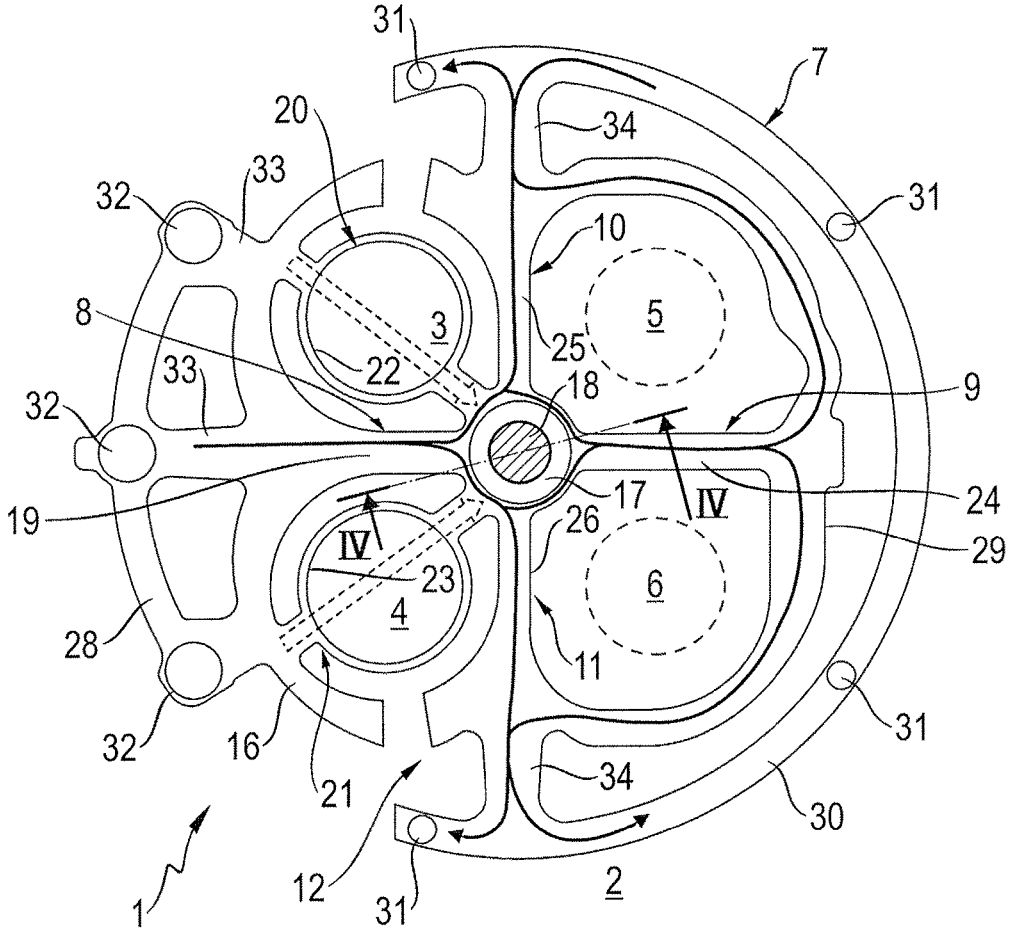
FIG. 5 shows the cooling structure in a further sectional plan view representation showing cast contours of outer and inner cooling chambers.

FIGS. 3, 5 and 6 show that the outer cooling chamber 16 is flow connected to an inlet cooling manifold 28 as part of an outer cooling chamber arrangement. The inlet cooling manifold 28 is formed as a circular ring segment, wherein the outer cooling chamber 16 is located between the inlet cooling manifold 28 and the exhaust valves 3, 4. The flow connection between outer cooling chamber 16 and inlet cooling manifold 28 is achieved by at least one first radial transfer passage 33. The first radial transfer passages 33 are aligned to the first radial passage 19 and/or the second radial passages 20, 21. In the present embodiment there are three first radial transfer passages 33.

Coolant, e.g. coming from the cylinder block, enters into the first cooling jacket 12 through one or more coolant entrance openings 32 which, in the embodiment shown, are located along the inlet cooling manifold 28. In an alternative design the outer cooling chamber 16 has coolant entrance openings 32' to be directly fed by coolant from a motor block water jacket. In that case the inlet cooling manifold 28 may be omitted. Also, combinations of coolant entrance openings 32, 32' in an inlet cooling manifold 28 and the outer cooling chamber 16 are possible.

In contrast to the known cooling structure of FIGS. 1 and 2, the outer cooling chamber arrangement of the first cooling jacket 12 in addition to the first outer cooling chamber 16 further includes a second outer cooling chamber 29 which is separated from the first outer cooling chamber 16 by a flow-restricting passage. In other words, according to the invention there is provided an outer cooling chamber arrangement with a first 16 and a second outer cooling chamber 29 which are interrupted by at least one flow-restricting passage 50, 51. The flow-restricting-passages may be solid interruptions 50 as is shown in FIGS. 3 and 5, or throttle points 51 as is shown in the detail in FIG. 6.

In the embodiment shown in the figures both outer cooling chambers 16, 29 have the form of basically circular ring segments with the same radius. The central point of the circular ring segments lies in the centre of the cooling structure 1, in particular where the location aperture for the fuel injector 18 is provided.

The circular ring segment of the first outer cooling chamber 16 covers an angular range of 10° to 165°, preferably 90°; the circular ring segment of the second outer cooling chamber 29 covers an angular range of 10° to 300°, preferably of 180°.

The second outer cooling chamber 29 is flow connected with the centre cooling chamber 17 by one or more intake radial passages 24, 25, 26 extending in the region of the intake valve bridge 9 and in the regions of the intake-exhaust valve bridges 10, 11. A first intake radial passage 24 extends in the region of the intake valve bridge 9, and second intake radial passages 25, 26 extend in the regions of the intake-exhaust valve bridges 10, 11.

The cooling manifold arrangement, in addition to the inlet cooling manifold 28, further includes a transfer cooling manifold 30. The second outer cooling chamber 29 is flow connected to the surrounding transfer cooling manifold 30. In the embodiment shown in FIGS. 3 and 5 this flow connection is achieved by second radial transfer passages 34, which are aligned to the second intake radial passages 25, 26. Even though two such second radial transfer passages 34 are shown, other arrangements with more and differently placed such passages are possible.

The transfer cooling manifold 30, which may be shaped as a circular ring segment, is separated from the inlet cooling manifold 28 by at least one flow-restricting passage 50, 51. In other words, according to the invention there is provided a cooling manifold arrangement with an inlet 28 and a transfer cooling manifold 30 which are separated by at least one flow-restricting passage 50, 51. In the embodiment shown in the figures, both inlet 28 and transfer cooling manifold 30 have the form of basically circular ring segments with the same radius. The circular ring segment of the inlet cooling manifold covers an angular range of 10° to 120°, preferably 90°; the circular ring segment of the transfer cooling manifold 30 covers an angular range of 10° to 300°, preferably of 200°.

In an alternative design the first cooling jacket 12 and the second cooling jacket 14 can be connected with additional second transfer openings 31 arranged in the region of second radial transfer passages 34 and/or also on the second outer cooling chamber 29. In that case the transfer cooling manifold 30 may be omitted. Combinations of first 27 and second transfer openings 31 are possible.

The first and second radial passages 19, 20, 21 are flowed through by the coolant in parallel. With the coolant entrance openings 32 being arranged on the exhaust side, e.g., along the inlet cooling manifold 28, the intake radial passages 24, 25, 26 are arranged downstream of the first and second radial passages 19, 20, 21. Hence, coolant is first directed to the thermally critical areas of the cylinder head 2 and heat is efficiently discharged from there.

The first 12 and second cooling jackets 14 are flow connected by transfer openings 27, 31 of the intermediate deck 15. A first transfer opening 27 originates from the centre cooling chamber 17 and second transfer openings 31 originate from the transfer cooling manifold 30 and/or from the region of second radial transfer passages 34. The flow cross section of the first transfer opening 27 of the centre cooling chamber 17 may be designed smaller than the flow section of at least one second transfer opening 31 of the transfer cooling manifold 30, in order to keep most of the coolant in the lower first coolant jacket 12. In detail the transfer opening 27 may be designed as very small gap by appropriate manufacturing methods to force more coolant into radial passages 24, 25, 26 by impeding flow through the first transfer opening 27. Optionally the first transfer opening 27 may be closed completely or omitted.

The cross section of the centre cooling chamber 17 around the centric fuel injector 18 (or a pre-chamber in case of gas engines) may be designed equal or smaller than the sum of minimal cross sections of the first radial passage 19 and the annular cooling channels 22, 23. A small cross section leads to larger pressure loss in the passage; at the same time the high flow velocity causes larger turbulences leading to improved cooling of the valve bridges.

The coolant flows according to the arrows shown in FIG. 3 through coolant entrance openings 32 into the inlet coolant manifold 28 and via first radial transfer passages 33 into the first outer cooling chamber 16 and passes first radial passage 19 and second radial passages 20, 21 in parallel. Because of the flow restricting passages 50, 51 in the outer cooling chamber arrangement and the cooling manifold arrangement the coolant is prevented from flowing in the circumferential direction and guided to the centre of the cooling structure 1.

The coolant is collected in the region of the inner cooling chamber 17. A minor part of the coolant streams through the first transfer opening 27 directly into the upper second cooling jacket 14. The rest of the coolant flows through the intake radial passages 24, 25, 26 to the second outer cooling chamber 29, which is connected to the transfer cooling manifold 30 by second radial transfer passages 34. The coolant discharges into the upper second cooling jacket 14 and towards main outlet via transfer openings 31 located in the transfer cooling manifold 30 and/or located in the region of second radial transfer passages 34.

FIG. 6 shows a detail of the cooling structure 1 according to the invention with different variants of the flow-restricting passages 50, 51. In case of the outer cooling chamber arrangement the first outer cooling chamber 16 and the second outer cooling chamber 29 are separated by a throttle point 51. Throttle point 51 here means that the cross section of the chamber arrangement is reduced to a minimum, consequently impeding the flow.

In case of the cooling manifold arrangement, FIG. 6 shows the variant of FIGS. 3 and 5 in solid lines where the flow-restricting passage is realized as a solid interruption. Material of the cylinder head is provided between the inlet cooling manifold 28 and the transfer cooling manifold 30, preventing flow between the two. Dotted lines show a variant where also in the cooling manifold arrangement a throttle point is provided.

Good results are obtainable with the cross sectional area of the throttle points 51 being between 5 and 10 percent of the cross section of first outer cooling chamber 16 and second outer cooling chamber 29 and inlet cooling manifold 28 and transfer cooling manifold 39.

Both the outer cooling chamber arrangement and the cooling manifold arrangement have two flow-restricting passages 50, 51 each. It is possible to implement various combinations of flow-restricting passages 50, 51, i.e., having two throttle points 51 and/or two solid interruptions 50 in each or one of the arrangements. It is also possible to have one throttle point 51 and one solid combination 50 in each or one of the arrangements.

The arrangement described above enables full flow of coolant for the exhaust side. The intake valve bridge 9 and the intake-exhaust valve bridges 10, 11 are cooled with part coolant flow, wherein the coolant is distributed within the centre cooling chamber 17 around the injector 18 into both first intake radial passage 24 of the intake valve bridge 9 and second intake radial passages 25, 26 of the intake-exhaust valve bridges 10, 11. In contrast to the cooling structure of FIG. 1 the flow direction of intake radial cooling passages 24, 25, 26 is from the centre cooling chamber 17 to the outer region of the lower first water jacket 12, i.e., to the second outer cooling chamber 29.

The advantage of the cooling structure shown in FIGS. 3 to 6 is that full coolant flows through the exhaust valve bridge 8 and the annular cooling channels 22, 23 of the seats of the exhaust valves 3, 4. Degas-drillings or bypasses may be handled by the transfer coolant manifold 30 in case of engine built-in position allows that. The part coolant flow in second intake radial passages 25, 26 of intake-exhaust valve bridges 10, 11 may cause high turbulence, which increase the heat transfer.

The invention claimed is:

1. A cooling structure for a cylinder head of an internal combustion engine with at least two exhaust valves and at least one intake valve per cylinder, wherein at least one exhaust valve bridge is located between two adjacent exhaust valves and at least two intake-exhaust valve bridges are located each between an exhaust valve and an adjacent intake valve, the cooling structure comprising a lower first cooling jacket adjacent to a fire deck and an upper second cooling jacket adjacent to an intermediate deck, the first and second cooling jackets being flow connected by at least one transfer opening of the intermediate deck, the lower first cooling jacket including at least one centre cooling chamber and an outer cooling chamber arrangement with at least one first outer cooling chamber, the first outer cooling chamber and the centre cooling chamber being flow connected by at least one exhaust side first radial passage extending in a region of the exhaust valve bridge and by at least one second radial passage, wherein the first exhaust side radial passage and the second radial passage are streamed hydraulically in parallel, wherein the outer cooling chamber arrangement of the lower first cooling jacket comprises at least one first outer cooling chamber and at least one second outer cooling chamber, which is separated from the first outer cooling chamber by at least one flow-restricting passage comprising a solid interruption or a throttle point, wherein the second outer cooling chamber is flow connected with the centre cooling chamber by at least one radial passage extending in a region of the intake valve bridge and/or in a region of the intake-exhaust valve bridge, wherein the lower first cooling jacket includes at least one cooling manifold arrangement with at least one inlet cooling manifold which is flow connected to the first outer cooling chamber and at least one transfer cooling manifold which is flow connected to the second outer cooling chamber, wherein the inlet cooling manifold is separated from the transfer cooling manifold by at least one flow-restricting passage comprising a solid interruption or a throttle point.

2. The cooling structure according to claim 1, wherein the first outer cooling chamber is arranged on the exhaust side and/or that the second outer cooling chamber is arranged on the intake side.

3. The cooling structure according to claim 1, wherein the transfer cooling manifold surrounds the second outer cooling chamber as a circular ring segment.

4. The cooling structure according to claim 1, wherein coolant enters the cooling structure through at least one coolant entrance opening located upstream of the at least one first and/or second radial passage and the at least one radial passage is located downstream of the first and/or second radial passage.

5. The cooling structure according to claim 1, wherein the at least one first transfer opening originates from the centre cooling chamber (17).

6. The cooling structure according to claim 1, wherein the at least one second transfer opening originates from the second outer cooling chamber or from the transfer cooling manifold.

7. The cooling structure according to claim 6, wherein multiple second transfer openings originate from the second outer cooling chamber and/or from the transfer cooling manifold and/or from the region of second radial transfer passages flow connecting the second outer cooling chamber and the transfer cooling manifold.

8. The cooling structure according to claim 1, wherein a flow section of a first transfer opening of the centre cooling chamber is smaller than a flow section of an at least one second transfer opening of the second outer cooling chamber or the transfer cooling manifold.

9. The cooling structure according to claim 1, wherein the first outer cooling chamber is located between the inlet cooling manifold and the exhaust valves.

10. The cooling structure according to claim 1, wherein the inlet cooling manifold is formed as a circular ring segment.

11. The cooling structure according to claim 1, wherein at least one intake valve bridge is located between two adjacent intake valves.

12. The cooling structure according to claim 1, wherein the exhaust valve comprises a valve seat which is surrounded by an annular cooling channel.

* * * * *